US006536881B1

(12) United States Patent
Sherman et al.

(10) Patent No.: US 6,536,881 B1
(45) Date of Patent: Mar. 25, 2003

(54) CONTINUOUS STREAM INK JET PRINT HEAD DROPLET GENERATOR HAVING BACKING MEMBER BRIDGING DIVIDED VIBRATOR

(75) Inventors: Nigel Edward Sherman, Edmunds (GB); Graham Dagnall Martin, Cambridge (GB); Sukbir Singh Pannu, Cambridge (GB)

(73) Assignee: Marconi Data Systems Inc., Wood Dale, IL (US)

( * ) Notice: Subject to any disclaimer, the term of this patent is extended or adjusted under 35 U.S.C. 154(b) by 0 days.

(21) Appl. No.: 09/242,984

(22) PCT Filed: Aug. 22, 1997

(86) PCT No.: PCT/GB97/02262

§ 371 (c)(1),
(2), (4) Date: May 24, 1999

(87) PCT Pub. No.: WO98/08685

PCT Pub. Date: Mar. 5, 1998

(30) Foreign Application Priority Data

Aug. 28, 1996 (GB) ..... 9617908

(51) Int. Cl.[7] ..... B41J 2/02
(52) U.S. Cl. ..... 347/75
(58) Field of Search ..... 347/74, 75, 76, 347/68, 73

(56) References Cited

U.S. PATENT DOCUMENTS 4,032,928 A * 6/1977 White et al. ..... 347/75
4,138,687 A * 2/1979 Cha et al. ..... 347/75
4,587,528 A * 5/1986 Beaudet ..... 347/75
4,999,647 A * 3/1991 Wood et al. ..... 347/75
5,502,473 A * 3/1996 East et al. ..... 347/73
5,589,863 A * 12/1996 Janse V. Rensburg et al. ..... 347/75
5,910,809 A * 6/1999 Usui et al. ..... 347/72
5,912,686 A * 6/1999 Palmer et al. ..... 347/75
6,425,660 B1 * 7/2002 Sherman et al. ..... 347/75

FOREIGN PATENT DOCUMENTS

EP 0051132 * 5/1982 ..... B41J/3/04

* cited by examiner

*Primary Examiner*—Michael Nghiem
(74) *Attorney, Agent, or Firm*—Piper Rudnick; Joel H. Bootzin

(57) ABSTRACT

A continuous stream ink jet print head has a droplet generator with an elongate cavity for containing the ink, and nozzle orifices in a wall of the cavity for passing ink from the cavity to form jets. The nozzle orifices are disposed at spaced positions along the length of the cavity. An actuator for vibrating the ink in the cavity is provided such that each jet breaks up into ink droplets at the same predetermined distance from the wall of the cavity. The actuator is disposed on the opposite side of the cavity to the wall, includes a vibrator which is divided up along the length of the cavity at least partially into at least two parts, and includes a backing member disposed further from the cavity than the vibrator and secured to and bridging the parts into which the vibrator is at least partially divided. The vibrator is interposed in line between the backing member and the cavity.

10 Claims, 4 Drawing Sheets

CONTINUOUS STREAM INK JET PRINT HEAD DROPLET GENERATOR HAVING BACKING MEMBER BRIDGING DIVIDED VIBRATOR

BACKGROUND

This invention relates to a droplet generator for a continuous stream ink jet print head.

More particularly the invention relates to such a generator comprising: an elongate cavity for containing the ink; nozzle orifices in a wall of said cavity for passing ink from the cavity to form-jets, said nozzle orifices extending along the length of said cavity; and actuator means for vibrating the ink in said cavity such that each said jet breaks up into ink droplets at the same predetermined distance from said wall of the cavity, said actuator means being disposed on the opposite side of said cavity to said wall and comprising vibration means which is divided up along the length of said cavity at least partially into at least two parts. An example of such a generator is disclosed in U.S. Pat. No. 4,587,528. In order that each jet breaks up at the same distance from the generator, it is necessary that the vibration of the actuator means has no component along the length of the ink cavity. The at least partial division of the vibration means of the actuator means inhibits such components.

SUMMARY OF THE INVENTION

According to the present invention there is provided a droplet generator for a continuous stream ink jet print head comprising: an elongate cavity for containing the ink; nozzle orifices in a wall of said cavity for passing ink from the cavity to form jets, said nozzle orifices extending along the length of said cavity; and actuator means for vibrating the ink in said cavity such that each said jet breaks up into ink droplets at the same predetermined distance from said wall of the cavity, said actuator means being disposed on the opposite side of said cavity to said wall and comprising vibration means which is divided up along the length of said cavity at least partially into at least two parts, characterised in that said actuator means further comprises a backing member disposed further from said cavity than said vibration means and secured to and bridging said parts into which said vibration means is at least partially divided, said vibration means being interposed in line between said backing member and said cavity.

Preferably, said actuator means further comprises a head on the opposite side of said vibration means to said backing member and secured to and bridging said parts into which said vibration means is at least partially divided.

Preferably, said vibration means is divided up along the length of said cavity into at least two spaced parts. Suitably, the number of spaced parts is three.

Preferably, said vibration means is made of piezoelectric material.

Preferably, the backing member and, when provided, the head are made of an electrically conductive material. Suitably, the electrically conductive material is brass for the backing member, and steel for the head.

BRIEF DESCRIPTION OF THE DRAWINGS

A droplet generator in accordance with the present invention will now be described, by way of example, with reference to the accompanying schematic drawings, in which.

DETAILED DESCRIPTION OF THE PREFERRED EMBODIMENT

Figure 1:
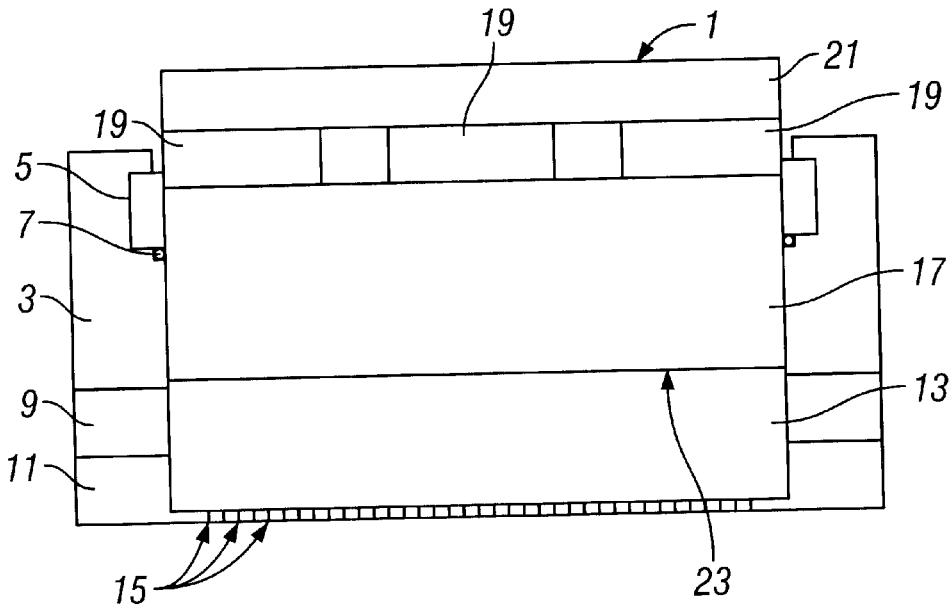
FIG. 1 is a front view of the generator.
Figure 2:
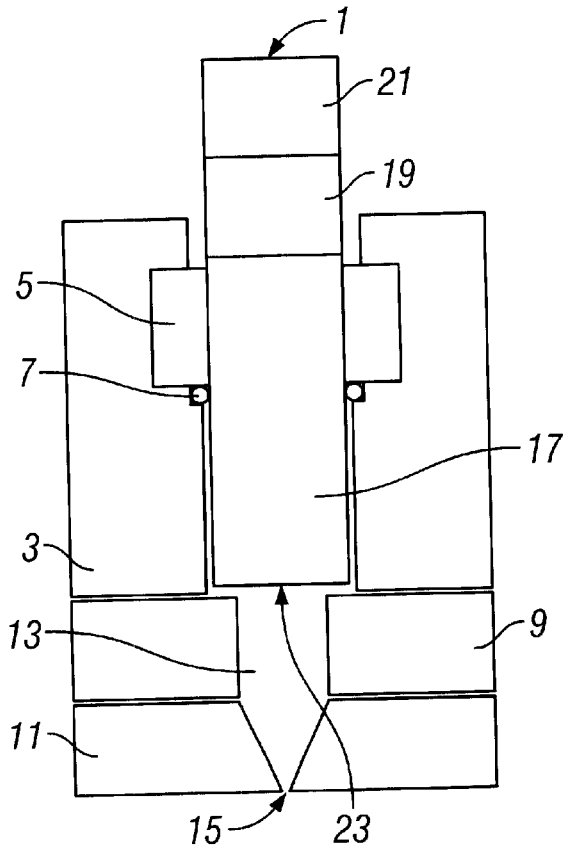
FIG. 2 is a side view of the generator of FIG. 1.

Referring to FIGS. 1 and 2, the generator comprises an actuator 1 held within a manifold 3 by means of a compliant element 5 and an O-ring 7. A spacer 9 and a nozzle plate 11 define, and form walls for, an elongate cavity 13 below actuator 1 to which ink is supplied under pressure. Nozzle plate 11 contains a line of nozzle orifices 15.

Figure 3B:
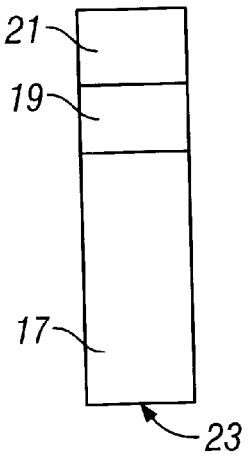
FIGS. 3A, 3B and 3C illustrate respectively front, side and plan views of an actuator of the generator of FIG. 1.
Figure 3A:
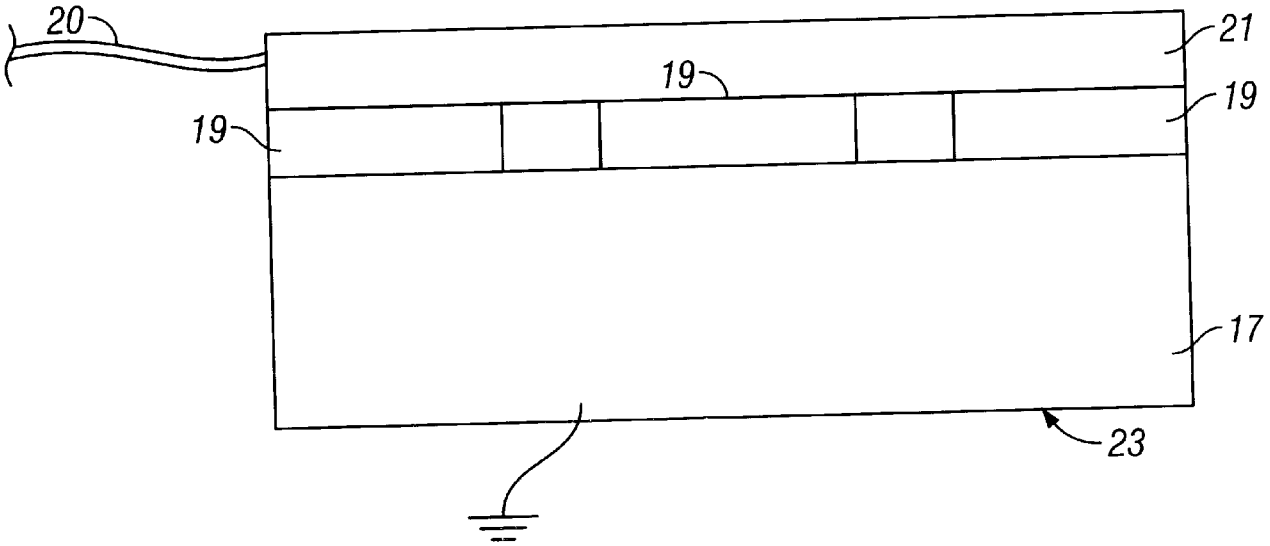
Figure 3C:
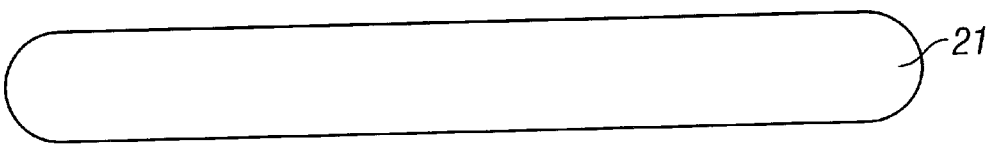

Referring also to FIGS. 3A, 3B and 3C, actuator 1 comprises a steel head 17, three spaced apart elements 19 of piezoelectric material secured to head 17, and a brass backing member 21 secured to and bridging elements 19. Piezoelectric elements 19 are driven by means of a single electrical connection 20 to brass backing member 21 and the earthing of steel head 17.

Actuator 1 has a resonant frequency at which all points across bottom face 23 of actuator 1 vibrate vertically in phase and with the same amplitude, i.e. at which bottom face 23 is driven in contact with the ink in cavity 13 in piston-like manner. At this frequency actuator 1 exhibits a vertical longitudinal mode of vibration, without the added interference of waves generated in other directions in actuator 1, which would give rise to complex 30 vibrations across bottom face 23. Let this resonant frequency be termed the longitudinal resonant frequency. Let the other resonant frequencies of actuator 1, which do include the added interference of waves generated in other directions, be termed mixed resonant frequencies. Since at the longitudinal resonant frequency all points across bottom face 23 vibrate vertically in phase and with the same amplitude, the wave imparted to the ink in cavity 13 will cause each ink jet emanating from a nozzle orifice 15 to break up into droplets at the same distance from nozzle plate 11.

That actuator 1 has a longitudinal resonant frequency is attributable to the following. The following also contribute to this resonant frequency being sufficiently far away from the mixed resonant frequencies, ie. contributes to the longitudinal resonant frequency having a sufficiently broad bandwidth on each side of it between it and its adjacent mixed resonant frequencies.

(i) The divided-up nature of the piezoelectric part of actuator 1 generally inhibits horizontal components of vibration.

Figure 4:
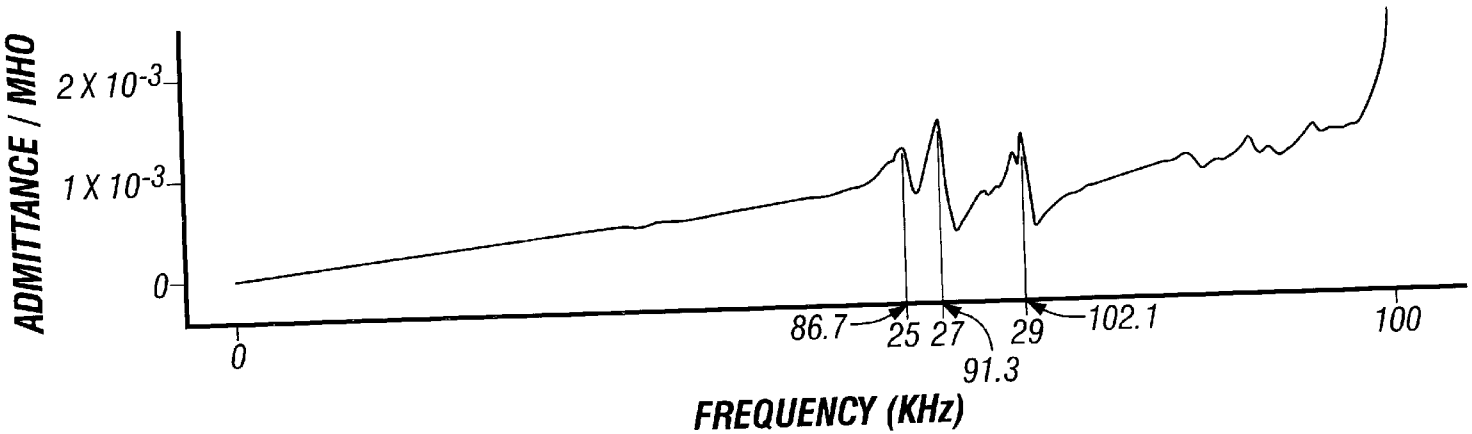
FIG. 4 is a graph of the frequency response of the actuator of FIGS. 3A, 3B and 3C with a backing member thereof removed.
Figure 5:
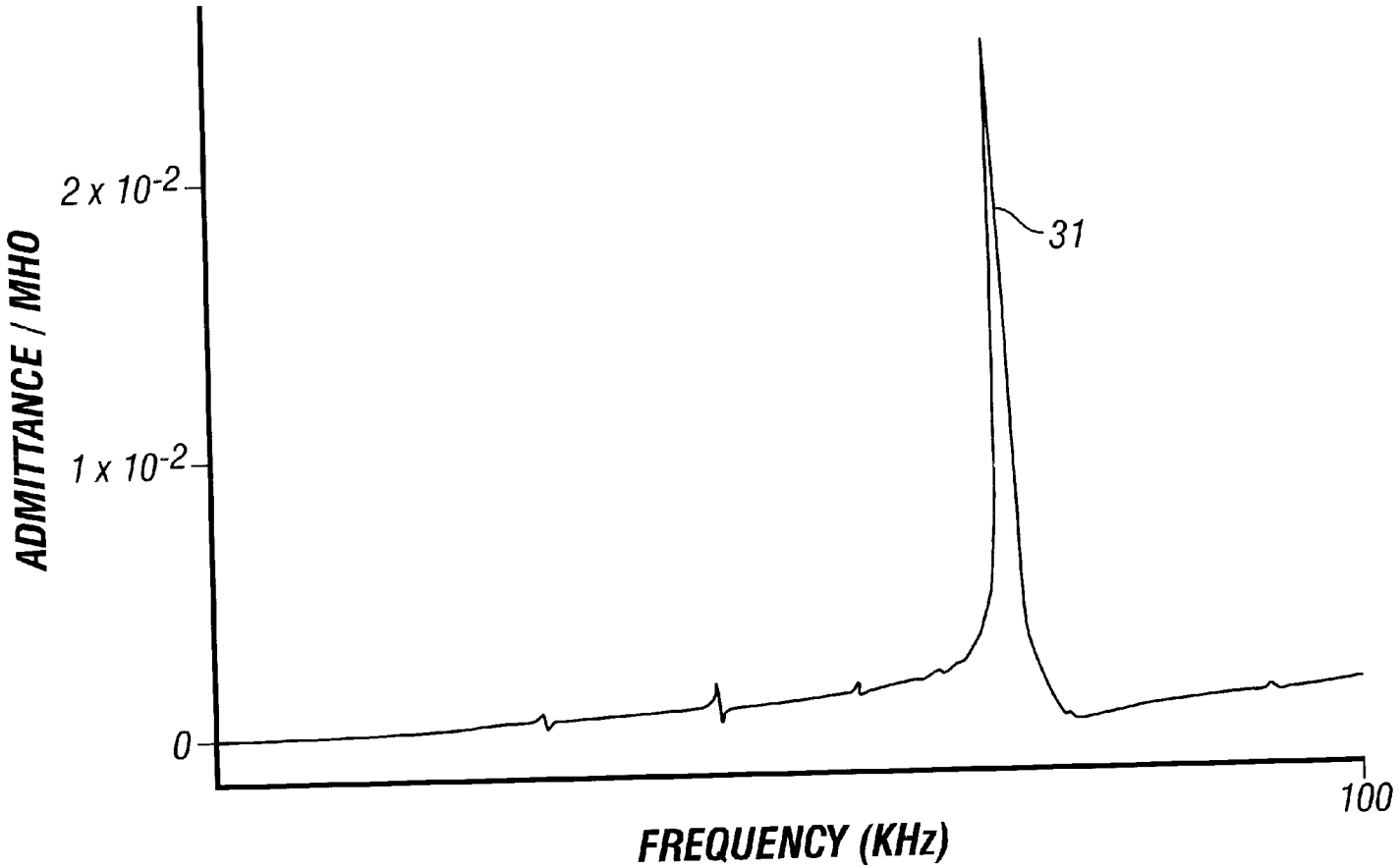
FIG. 5 is a graph of the frequency response of the actuator of FIGS. 3A, 3B and 3C with the backing member in place.

(ii) The physical coupling together of piezoelectric elements 19 at their top and bottom faces by means of rigid elements 21, 17 respectively, alleviates the consequences of variation in precise physical size and operational properties between piezoelectric elements 19, by averaging out their individual responses. In this connection, referring to FIG. 4, at the frequency of each of peaks 25, 27, 29, the vibration of actuator 1 is close to being, but is not entirely, longitudinal. Each of peaks 25, 27, 29 corresponds to a respective one of piezoelectric elements 19. Peaks 25, 27, 29 are spread due to the aforementioned variation in precise physical size and operational properties between elements 19. Thus, it will be seen that there is no clear longitudinal resonant frequency. Referring to FIG. 5, at the frequency of peak 31 the vibration of actuator 1 is entirely longitudinal. Thus, it will be seen that backing member 21 averages out the individual responses of piezoelectric elements 19 to provide a clear longitudinal resonant frequency.

(iii) The presence of backing member 21 increases the flexibility in tuning of actuator 1.

Actuator 1 must be tuned such that the longitudinal resonant frequency is at the desired frequency of operation of the droplet generator. This is done by making the height of actuator 1 equal to half of the wavelength which corresponds to the desired frequency of operation. In this connection, it should be noted that the half wavelength will be a composite half wavelength, since three different materials (steel, piezoelectric and brass) are present, having three different speeds of sound therein. Further, actuator 1 must be tuned such that there are no mixed resonant frequencies too near to the longitudinal resonant frequency.

The height of steel head 17 is often dictated/fixed by factors related to the general design of the ink jet print head. Thus, if backing member 21 were not present, to achieve longitudinal resonance at a particular frequency, would fix, and leave no leeway with regard to, the height of piezoelectric elements 19. Therefore, if there was present an undesirably close mixed resonant frequency, since the respective heights of head 17 and elements 19 are fixed, there is no room for adjustment of these heights to tune actuator 1 so as to push the undesirably close resonant frequency further away.

The presence of backing member 21 provides the required room for adjustment. Although the total height of actuator 1, and the height of head 17, are fixed, the respective heights of elements 19 and backing member 21 may be adjusted to push further away the aforementioned undesirable resonant frequency. Of course, the combined height of elements 19 and member 21, must such that when it is taken together with the fixed height of head 17, the total height of actuator 1 is equal to half the composite wavelength corresponding to the desired frequency of operation.

It is to be appreciated that since the undesirable resonant frequencies are ones with a horizontal component, to push these resonant frequencies further away from the longitudinal resonant frequency requires backing member 21 to span the width of actuator 1.

Figure 6:
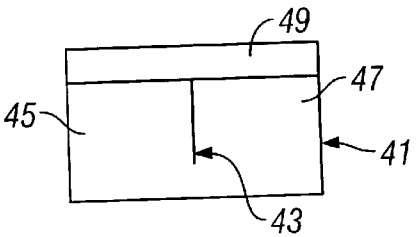

Referring to FIG. 6, in this alternative actuator, there is no steel head, and the piezoelectric part comprises a single piece 41 of piezoelectric material, with a slot 43 cut therein, which extends from the side remote from cavity 13 so as to partially divide piece 41 into two parts 45, 47. A backing member 49 is secured to and bridges parts 45, 47. Since piezoelectric piece 41 contacts the ink in cavity 13, a protective coating therefor is required.

Figure 7:
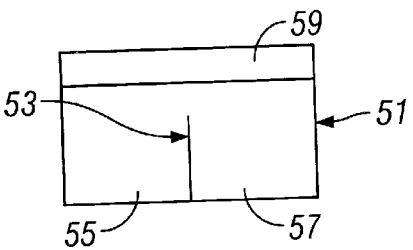
FIGS. 6 and 7 illustrate respectively alternative actuators.

Referring to FIG. 7, in this alternative actuator, again there is no steel head, again the piezoelectric part comprises a single piece 51 of piezoelectric material, and again a slot 53 is cut in piece 51 so as to partially divide it into two parts 55, 57. However, in this actuator the slot extends from the side which contacts the ink in cavity 13. Again a protective coating is provided for the piezoelectric part as it contacts the ink. Again a backing member 59 is secured to and bridges parts 55, 57.

What is claimed is:

1. A continuous stream ink jet print head comprising:

a droplet generator including an elongate cavity for containing the ink;

nozzle orifices in a wall of said cavity for passing ink from the cavity to form jets, said nozzle orifices being disposed at spaced positions along the length of said cavity;

actuator means for vibrating the ink in said cavity such that each said jet breaks up into ink droplets at the same predetermined distance from said wall of the cavity, said actuator means being disposed on the opposite side of said cavity to said wall, vibrating relative to said wall, and comprising vibration means which is divided up along the length of said cavity at least partially into at least two parts, characterized in that said actuator means further comprises a backing member disposed further from said cavity than said vibration means and secured to and bridging said parts into which said vibration means is at least partially divided, said vibration means being interposed in line between said backing member and said cavity; and charge and deflection electrodes for selectively charging and deflecting the droplets generated by said droplet generator depending on which droplets are to be used to print.

2. A print head according to claim 1 wherein said actuator means further comprises a head on the opposite side of said vibration means to said backing member and secured to and bridging said parts into which said vibration means is at least partially divided.

3. A print head according to claim 2 wherein said backing member and said head are made of an electrically conductive material.

4. A print head according to claim 3 wherein said backing member is made of brass and said head is made of steel.

5. A print head according to claim 1 wherein said vibration means is divided up along the length of said cavity into at least two spaced parts.

6. A print head according to claim 5 wherein the number of parts is three.

7. A print head according to claim 1 wherein said vibration means is made of piezoelectric material.

8. A print head according to claim 1, wherein said backing member is attached to all parts of said vibration means for providing a longitudinal resonant frequency at all positions along the length of the ink cavity so that said actuator means vibrates in phase and with one amplitude.

9. A print head according to claim 1, wherein said actuator means has a face which engages the ink in said cavity, and wherein said backing member averages out the individual responses of said parts into which said vibration means is at least partially divided to provide a resonant frequency at which all points on said face vibrate in phase and with the same amplitude.

10. A continuous stream ink jet print head, comprising:

a droplet generator including an elongate cavity for containing the ink; nozzle orifices in a wall of said cavity for passing ink from the cavity to form jets, said nozzle orifices being disposed at spaced positions along the length of said cavity; and actuator means for vibrating the ink in said cavity such that each said jet breaks up into ink droplets at the same predetermined distance from said wall of the cavity, said actuator means being disposed on the opposite side of said cavity to said wall, vibrating relative to said wall, and comprising vibration means which is divided up along the length of said cavity at least partially into at least two parts, characterized in that said actuator means further comprises a backing member disposed further from said cavity than said vibration means and secured to and bridging said parts into which said vibration means is at least partially divided, said vibration means being interposed in line between said backing member and said cavity and wherein said backing member averages out the individual responses of said parts into which said vibration means is at least partially divided to provide a resonant frequency at which all points on said face vibrate in phase and with the same amplitude.

* * * * *